US010485730B2

(12) United States Patent
Dobosz

(10) Patent No.: US 10,485,730 B2
(45) Date of Patent: Nov. 26, 2019

(54) MULTILAYERED DILDO

(71) Applicant: Lukasz Dobosz, New Baltimore, MI (US)

(72) Inventor: Lukasz Dobosz, New Baltimore, MI (US)

( * ) Notice: Subject to any disclaimer, the term of this patent is extended or adjusted under 35 U.S.C. 154(b) by 0 days.

(21) Appl. No.: 15/789,935

(22) Filed: Oct. 20, 2017

(65) Prior Publication Data

US 2019/0117496 A1 Apr. 25, 2019

(51) Int. Cl.
*A61H 19/00* (2006.01)

(52) U.S. Cl.
CPC ..... *A61H 19/44* (2013.01); *A61H 2201/1685* (2013.01)

(58) Field of Classification Search
CPC ..... A61H 19/00–21/00; A61H 211/1685
See application file for complete search history.

(56) References Cited

U.S. PATENT DOCUMENTS 9,649,249 B1 * 5/2017 Green ..... A61H 19/44
2006/0289012 A1 * 12/2006 Reddy ..... A61F 5/41 128/844
2010/0174137 A1 * 7/2010 Shim ..... A61F 5/41 600/38
2013/0178769 A1 * 7/2013 Schmidt ..... A61H 19/34 601/46
2015/0119636 A1 * 4/2015 Yenko ..... A61H 19/34 600/38
2017/0095397 A1 * 4/2017 Barnard ..... A61H 19/44
2017/0118957 A1 * 5/2017 Nunn ..... A01K 15/025

OTHER PUBLICATIONS

Alan Henry. "Why You Should Consider Condoms Even with Your Sec Toys." Lifehacker.com. Apr. 2, 2014. Accessed at https://lifehackercom/why-you-should-consider-condoms-even-with-your-sex-toys-1556889525 by examiner Nov. 30, 2018 (Year: 2014).*
Dr. Laura Berman. Intimate Basics—Dilator—Purple Dilator with 4 Sizes & Sleeve. www.youtube.com. Feb. 16, 2014. Available at https://www.youtube.com/watch?v=n-1QOxcsGE8. (accessed by examiner Mar. 10, 2019) (Year: 2014).*

* cited by examiner

*Primary Examiner* — Kristen Matter

(57) ABSTRACT

An adjustable girth dildo, consisting of a multilayered cylindrical shaft with a proximal end and a distal end. The dildo consists of layers, which can be applied or removed, allowing for increase or decrease adjustments to the girth of the cylindrical shaft. Apart from having these layers, the dildo can have two applicable embodiments. In the first embodiment, all layers of the dildo from the distal end to proximal end are hollow, like a snorkel with two openings at each end, for the ability to breathe through. In the second embodiment, the innermost layer of the dildo that runs the length of the cylinder is solid, while each additional layer has one opening at the proximal end, without the ability to breathe through.

1 Claim, 2 Drawing Sheets

MULTILAYERED DILDO

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable

STATEMENT REGARDING PRIOR DISCLOSURE BY THE INVENTOR OR A JOINT INVENTOR

Not Applicable

BACKGROUND OF THE INVENTION

1. Field of the Invention

This invention relates in general to sexual aid devices, and more particularly to dildos.

2. Description of the Related Art

Dildos have been commonly used for sexual aid by stimulation of erogenous zones of the human body. Examples included the use of dildos for clitoral stimulation or for insertion into body orifices, such as the vagina.

Conventional dildos have included means for increasing the degree of stimulation, such as means for inducing vibration on the user's body and which operate in conjunction with manipulation of the dildo.

Among the disadvantages and shortcomings of conventional dildos are that they do not provide adjustable girth options.

A dildo which can be adjusted for girth is desirable in that it would increase its versatility and comfort, while providing the user an option of choosing a girth which is most comfortable.

The need has therefore been recognized for a dildo which obviates the foregoing and other limitations and disadvantages of prior art dildos. Despite the various dildo apparatus in the prior art, there has heretofore not been provided a suitable and attractive solution to this problem.

SUMMARY OF THE INVENTION

The invention provides a dildo having a multiple layered shaft. The multilayered shaft has a distal end and a proximal end. The distal end of the shaft can be shaped in conformance with the end of the glans penis of the human male. The girth of the dildo can be increased or decreased as the layers are applied or removed through the proximal end. Layers can be applied over one another, in order to transition from a smaller girth to a larger girth. Layers can also be removed off of one another, in order to transition from a larger girth to a smaller girth. The ability to easily adjust girth by simply applying or removing layers gives the user adjustable comfort. Thereby providing a customizable experience to the user. The length of the dildo is variable or non-specific. Apart from having the above described features the dildo can have two applicable embodiments:

Embodiment 1. Shown in FIGS. 1-7. All layers of the dildo from the distal end to proximal end are hollow, like a snorkel with two openings at each end, for the ability to breathe through, during oral penetration.

Embodiment 2. Shown in FIGS. 8-14. The innermost layer of the dildo that runs the longitudinal length of the cylinder is solid, while each additional layer has one opening at the proximal end, without the ability to breathe through.

The foregoing and other advantages, objects and features of the invention will appear from the following description of the two embodiments in conjunction with the accompanying drawings.

DETAILED DESCRIPTION OF THE INVENTION

Figure 1:
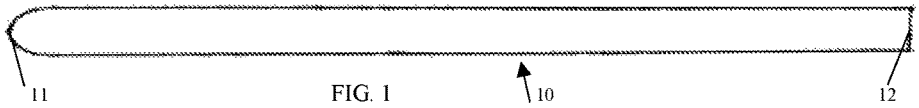
FIG. 1 is a side elevation view, of a dildo innermost layer in accordance with embodiment 1 of the invention.

In the drawings:

FIG. 1 illustrates generally a dildo innermost layer 10, in accordance with embodiment 1 of the invention. The dildo innermost layer is a hollow shaft which is cylindrical, preferably of circular cross-section. The dildo can be made of any desired material, and preferably the material is soft and compliant, such as rubber or Elastomer or a synthetic polymer. Also, the dildo could have a firmer innermost layer and relatively softer outer layers suitable for comfortable contact with the human body. The shaft has an innermost distal end 11 which can be shaped in conformance with the end of the glans penis of the human male, and an innermost proximal end 12.

Figure 2:
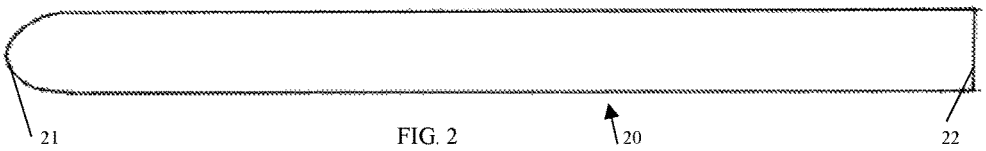
FIG. 2 is a side elevation view, of a dildo middle layer in accordance with embodiment 1 of the invention.

FIG. 2 illustrates generally a dildo middle layer 20, in accordance with embodiment 1 of the invention. The dildo middle layer is a cylindrical shaft having a middle proximal end 22 and a middle distal end 21.

Figure 3:
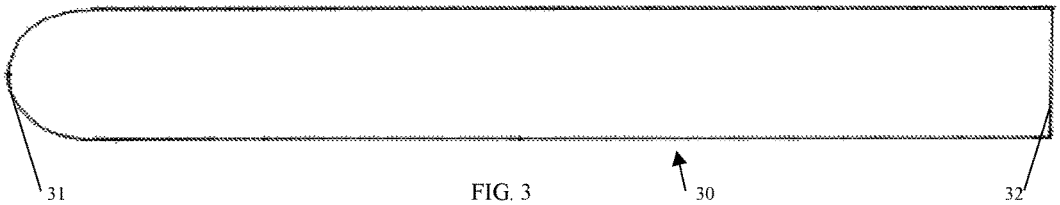
FIG. 3 is a side elevation view, of a dildo outermost layer in accordance with embodiment 1 of the invention.

FIG. 3 illustrates embodiment 1 providing a dildo outermost layer 30, is a shaft with an outermost distal end 31 and an outermost proximal end 32.

Figure 4:
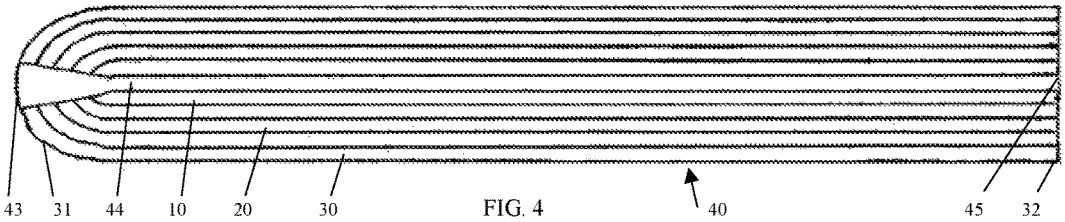
FIG. 4 is a side elevation view, of a full dildo cross-section in accordance with embodiment 1 of the invention.

FIG. 4 illustrates embodiment 1 providing a multilayered dildo 40 cross-section, with all layers applied, cut length wise from the outermost distal end 31 to the outermost proximal end 32. There is a distal end opening 43, which allows for air flow through the inner shaft cavity 44, and out of the proximal end opening 45. The innermost layer 10, middle layer 20, and outermost layer 30 are also shown. Additional intermediate layers can be applied between the innermost and outermost layers to form a densely-packed cylinder.

Figure 5:
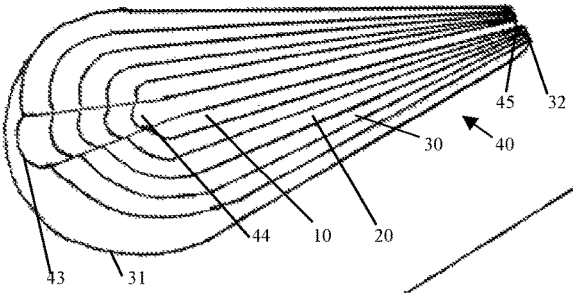
FIG. 5 is a side elevation view, of a dildo three-dimensional cross-section in accordance with embodiment 1 of the invention.

FIG. 5 illustrates embodiment 1 providing a three-dimensional multilayered dildo 40 cross-section, with all layers applied, cut length wise from the outermost distal end 31 to the outermost proximal end 32. There is a distal end opening 43, which allows for air to flow through the inner shaft cavity 44, and out of the proximal end opening 45. The innermost layer 10, middle layer 20, and outermost layer 30, along with other intermediate layers are also shown.

Figure 6:
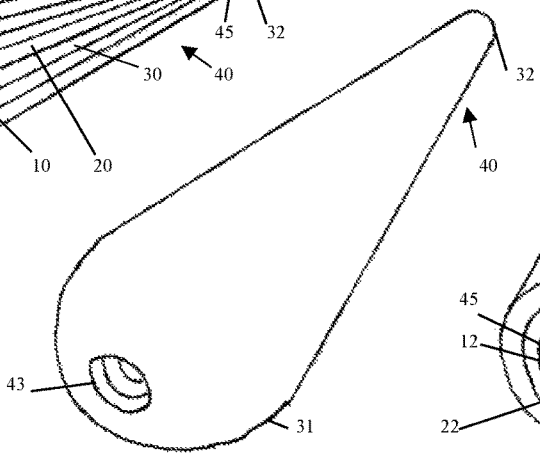
FIG. 6 is a side elevation view, of a full three-dimensional dildo in accordance with embodiment 1 of the invention.

FIG. 6 illustrates embodiment 1 providing a three-dimensional multilayered dildo 40, with all layers applied. The outermost distal end 31 and the outermost proximal end 32 as well as the distal end opening 43 are all shown from a more distal facing view.

Figure 7:
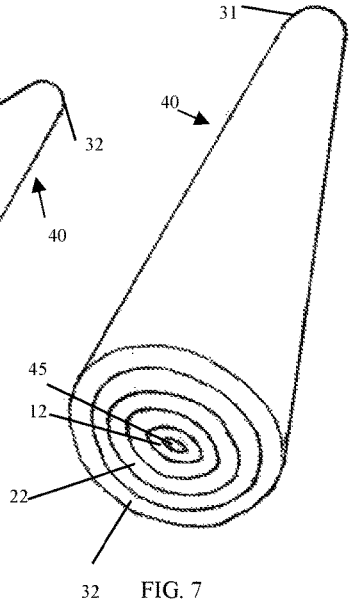
FIG. 7 is a side elevation view, of a full three-dimensional dildo in accordance with embodiment 1 of the invention.

FIG. 7 illustrates embodiment 1 providing a three-dimensional multilayered dildo 40, with all layers applied. The outermost distal end 31 and the outermost proximal end 32 along with the distal end opening 45 are all shown. The innermost proximal layer 12, middle proximal layer 22, along with other intermediate layers are also shown from a more proximal facing view.

Figure 8:
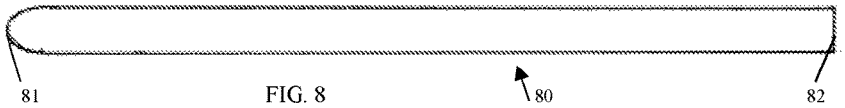
FIG. 8 is a side elevation view, of a dildo innermost layer in accordance with embodiment 2 of the invention.

FIG. 8 illustrates generally a dildo innermost layer 80 in accordance with embodiment 2 of the invention. The dildo innermost layer is a solid shaft which is cylindrical, preferably of circular cross-section. The dildo can be made of any desired material, and preferably the material is soft and compliant, such as rubber or Elastomer or a synthetic polymer. Also, the dildo could be a firmer innermost layer and relatively softer outer layers suitable for comfortable contact with the human body. The shaft has an innermost distal end 81 which can be shaped in conformance with the end of the glans penis of the human male, and an innermost proximal end 82.

Figure 9:
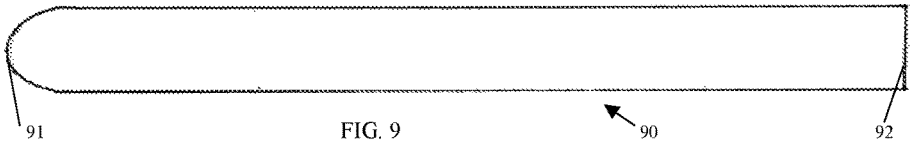
FIG. 9 is a side elevation view, of a dildo middle layer in accordance with embodiment 2 of the invention.

FIG. 9 illustrates generally a dildo middle layer 90 in accordance with embodiment 2 of the invention. The dildo middle layer is a cylindrical shaft having a middle proximal end 92 and a middle distal end 91.

Figure 10:
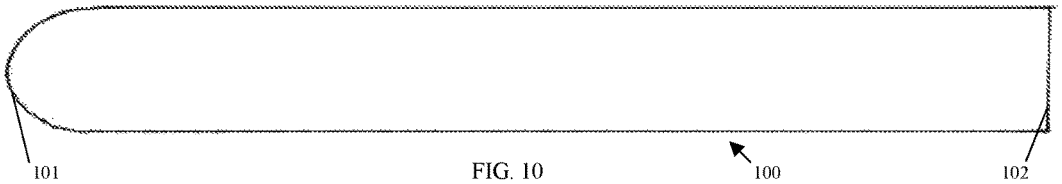
FIG. 10 is a side elevation view, of a dildo outermost layer in accordance with embodiment 2 of the invention.

FIG. 10 illustrates embodiment 2 providing a dildo outermost layer 100 is a shaft with an outermost distal end 101 and an outermost proximal end 102.

Figure 11:
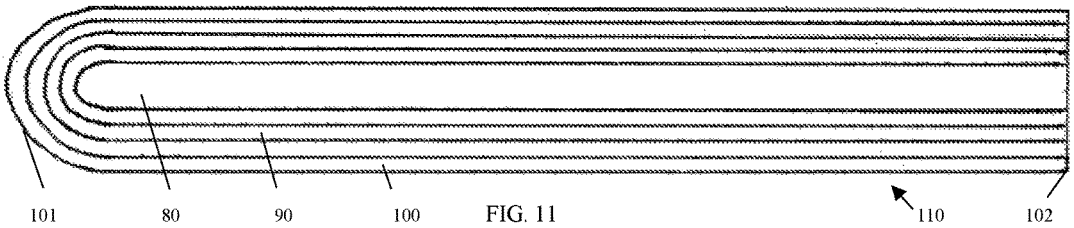
FIG. 11 is a side elevation view, of a full dildo cross-section in accordance with embodiment 2 of the invention.

FIG. 11 illustrates embodiment 2 providing a multilayered dildo 110 cross-section, with all layers applied, cut length wise from the outermost distal end 101 to the outermost proximal end 102. There is an innermost layer 80, middle layer 90, and outermost layer 100. All intermediate layers can be applied between the innermost and outermost layers to form a densely-packed circumference.

Figure 12:
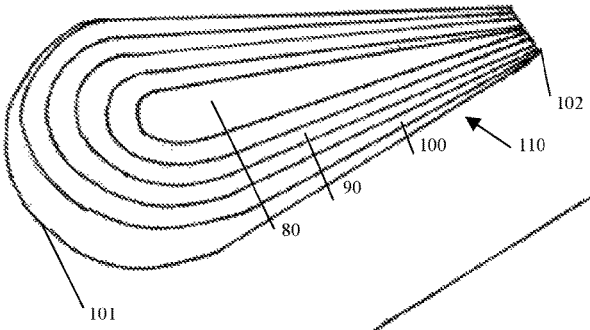
FIG. 12 is a side elevation view, of a dildo three-dimensional cross-section in accordance with embodiment 2 of the invention.

FIG. 12 illustrates embodiment 2 providing a dildo three-dimensional cross-section 110, with all layers applied, cut length wise from the distal end 101 to the proximal end 102. There is an innermost layer 80, middle layer 90 along with other intermediate layers, and an outermost layer 100.

Figure 13:
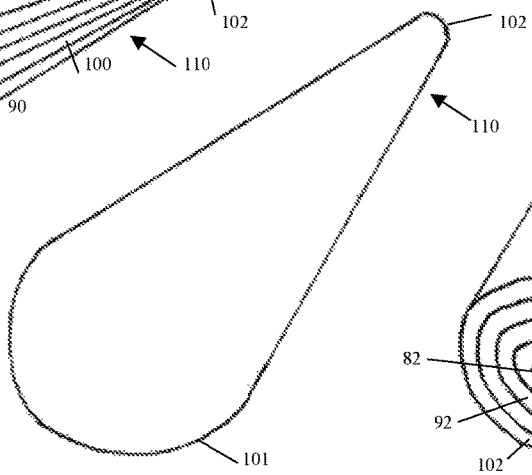
FIG. 13 is a side elevation view, of a full three-dimensional dildo in accordance with embodiment 2 of the invention.

FIG. 13 illustrates embodiment 2 providing a three-dimensional multilayered dildo 110, with all layers applied. The outermost distal end 101 and the outermost proximal end 102 are shown from a more distal facing view.

Figure 14:
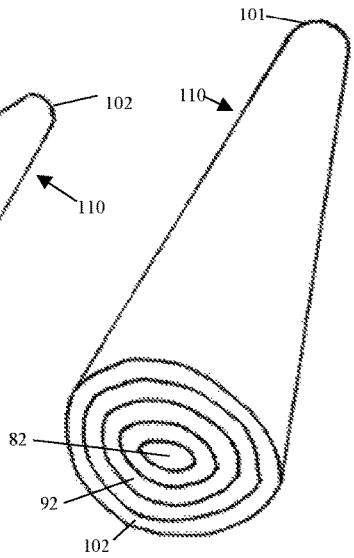
FIG. 14 is a side elevation view, of a full three-dimensional dildo in accordance with embodiment 2 of the invention.

FIG. 14 illustrates embodiment 2 providing a three-dimensional multilayered dildo 110, with all layers applied. The outermost distal end 101 and the outermost proximal end 102 are all shown. The innermost proximal end 82, and middle proximal end 92, and other intermediate layers are also shown from a more proximal facing view.

While the foregoing embodiments are at present considered to be preferred, it is understood that numerous variations and modifications may be made therein by those skilled in the art and it is intended to cover in the appended claims all such variations and modifications as fall within the true spirit and scope of the invention.

What is claimed is:

1. A dildo comprising:

a biocompatible shaft comprising a proximal end having a proximal end opening, a rounded distal end having a distal end opening and an inner shaft cavity extending from the distal end opening to the proximal end opening for allowing airflow through the inner shaft cavity; and at least two removable biocompatible layers applied over the shaft, each layer comprising a proximal end having a proximal end opening configured for applying a respective layer over either the shaft or another one of the layers such that the proximal ends of the shaft and respective layer lie on the same plane, a rounded distal end having a distal end opening aligned with the distal end opening of the shaft and configured for allowing a user to breathe through the inner shaft cavity during oral penetration, and a cavity extending from the distal end opening to the proximal end opening sized and configured to receive the shaft or another one of the layers therein;

wherein the girth of the dildo is customizable by applying at least one of the layers to the shaft or removing at least one of the layers from the shaft.

* * * * *